US010575691B2

(12) United States Patent
Fogarty, Jr. et al.

(10) Patent No.: US 10,575,691 B2
(45) Date of Patent: Mar. 3, 2020

(54) UPRIGHT VACUUM CLEANER INCLUDING ROTARY BRUSH

(71) Applicant: Emerson Electric Co., St. Louis, MO (US)

(72) Inventors: Thomas E. Fogarty, Jr., Alton, IL (US); John L. Theising, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 318 days.

(21) Appl. No.: 15/620,136

(22) Filed: Jun. 12, 2017

(65) Prior Publication Data

US 2018/0353026 A1 Dec. 13, 2018

(51) Int. Cl.

| | |
|---|---|
| ***A47L 9/04*** | (2006.01) |
| ***A47L 5/30*** | (2006.01) |
| ***A47L 9/28*** | (2006.01) |
| ***A47L 9/32*** | (2006.01) |

(52) U.S. Cl.

CPC ..... *A47L 9/0444* (2013.01); *A47L 5/30* (2013.01); *A47L 9/0411* (2013.01); *A47L 9/0477* (2013.01); *A47L 9/28* (2013.01); *A47L 9/2805* (2013.01); *A47L 9/2847* (2013.01); *A47L 9/2857* (2013.01); *A47L 9/2878* (2013.01); *A47L 9/2884* (2013.01); *A47L 9/325* (2013.01)

(58) Field of Classification Search

CPC ..... A47L 9/0444; A47L 9/0477

See application file for complete search history.

(56) References Cited

U.S. PATENT DOCUMENTS

| | | | |
|---|---|---|---|
| 4,245,370 | A | 1/1981 | Baker |
| 4,637,092 | A | 1/1987 | Hayashi et al. |
| 5,213,421 | A | 5/1993 | Ide |
| 5,230,121 | A | 7/1993 | Blackman |
| 5,297,312 | A | 3/1994 | Zuiderveen et al. |
| 5,632,060 | A | 5/1997 | Steinberg et al. |
| 6,406,514 | B1 | 6/2002 | Vystrcil et al. |
| 9,456,723 | B2 | 10/2016 | Thorne et al. |
| 2005/0022339 | A1 | 2/2005 | Hafling et al. |
| 2010/0242223 | A1 | 9/2010 | Maguire et al. |
| 2010/0257680 | A1 * | 10/2010 | Maguire ..... A47L 9/0433 15/21.1 |

FOREIGN PATENT DOCUMENTS

| | | |
|---|---|---|
| GB | 2468908 A | 9/2010 |

* cited by examiner

*Primary Examiner* — Andrew A Horton
(74) *Attorney, Agent, or Firm* — Armstrong Teasdale LLP

(57) ABSTRACT

An upright vacuum cleaner includes a cleaning head for removing debris from a floor, a rotary brush for agitating the debris, and a debris tube connected to the cleaning head for receiving the debris from the cleaning head. The upright vacuum cleaner also includes a motor to drive the rotary brush. The motor includes a rotatable drive shaft. The upright vacuum cleaner further includes a pulley assembly adapted to operatively connect the motor to the rotary brush. The pulley assembly includes a clutch and a belt. The belt is adapted to extend between the drive shaft and the clutch. The clutch is connected to the rotary brush to rotate the rotary brush. The upright vacuum cleaner also includes a clamp connecting the clutch to the cleaning head. The tightness of the belt is adjusted when the clamp moves between an unfastened position and a fastened position.

10 Claims, 7 Drawing Sheets

UPRIGHT VACUUM CLEANER INCLUDING ROTARY BRUSH

FIELD

The field relates to vacuum cleaners and, in particular, upright vacuum cleaners that include a rotary brush and a pulley assembly connected to the rotary brush.

BACKGROUND

Vacuum cleaners typically include a cleaning head and a debris tube connected to the cleaning head. Some known vacuum cleaners include a rotary brush in the cleaning head that rotates to entrain debris into an airflow through the cleaning head. The rotary brush may be connected to a drive motor by a pulley such that the motor rotates the rotary brush. During operation of the vacuum cleaner, debris may collect on and around the rotary brush. Such debris may prevent rotation of the rotary brush, which can cause damage to components of the vacuum cleaner such as the motor.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, an upright vacuum cleaner includes a cleaning head for removing debris from a floor, a rotary brush for agitating the debris, and a debris tube connected to the cleaning head for receiving the debris from the cleaning head. The upright vacuum cleaner also includes a motor to drive the rotary brush. The motor includes a rotatable drive shaft. The upright vacuum cleaner further includes a pulley assembly adapted to operatively connect the motor to the rotary brush. The pulley assembly includes a clutch and a belt. The belt is adapted to extend between the drive shaft and the clutch. The clutch is connected to the rotary brush to rotate the rotary brush. The upright vacuum cleaner also includes a clamp connecting the clutch to the cleaning head. The clamp is positionable or movable between an unfastened position and a fastened position. The tightness of the belt is adjusted when the clamp moves between the unfastened position and the fastened position.

In another aspect, an upright vacuum cleaner includes a rotary brush including a first end and a second end. The upright vacuum cleaner also includes a cleaning head including a front wall, a rear wall, a first sidewall, and a second sidewall. The first sidewall and the second sidewall extend between the front wall and rear wall. The rotary brush is positioned between the first sidewall and the second sidewall. The first sidewall defines an opening for removal of the rotary brush. The upright vacuum cleaner further includes a removable panel connected to the first sidewall to cover the opening. The first end of the rotary brush is adapted to engage the removable panel when the removable panel covers the opening. The upright vacuum cleaner also includes a pulley assembly connected to the second end of the rotary brush and a motor to drive the rotary brush. The pulley assembly is adapted to connect the motor to the rotary brush.

In yet another aspect, a method of servicing a vacuum cleaner includes providing a cleaning head including a front wall, a rear wall, a first sidewall, and a second sidewall. The first sidewall and the second sidewall extend between the front wall and rear wall. The method also includes positioning a rotary brush between the first sidewall and the second sidewall. A first end of the rotary brush is adjacent the first sidewall and a second end of the rotary brush is adapted to engage a pulley assembly adjacent the second sidewall. The method further includes removing a panel from the cleaning head to uncover an opening in the first sidewall of the cleaning head. The method also includes removing the rotary brush from the cleaning head through the opening.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
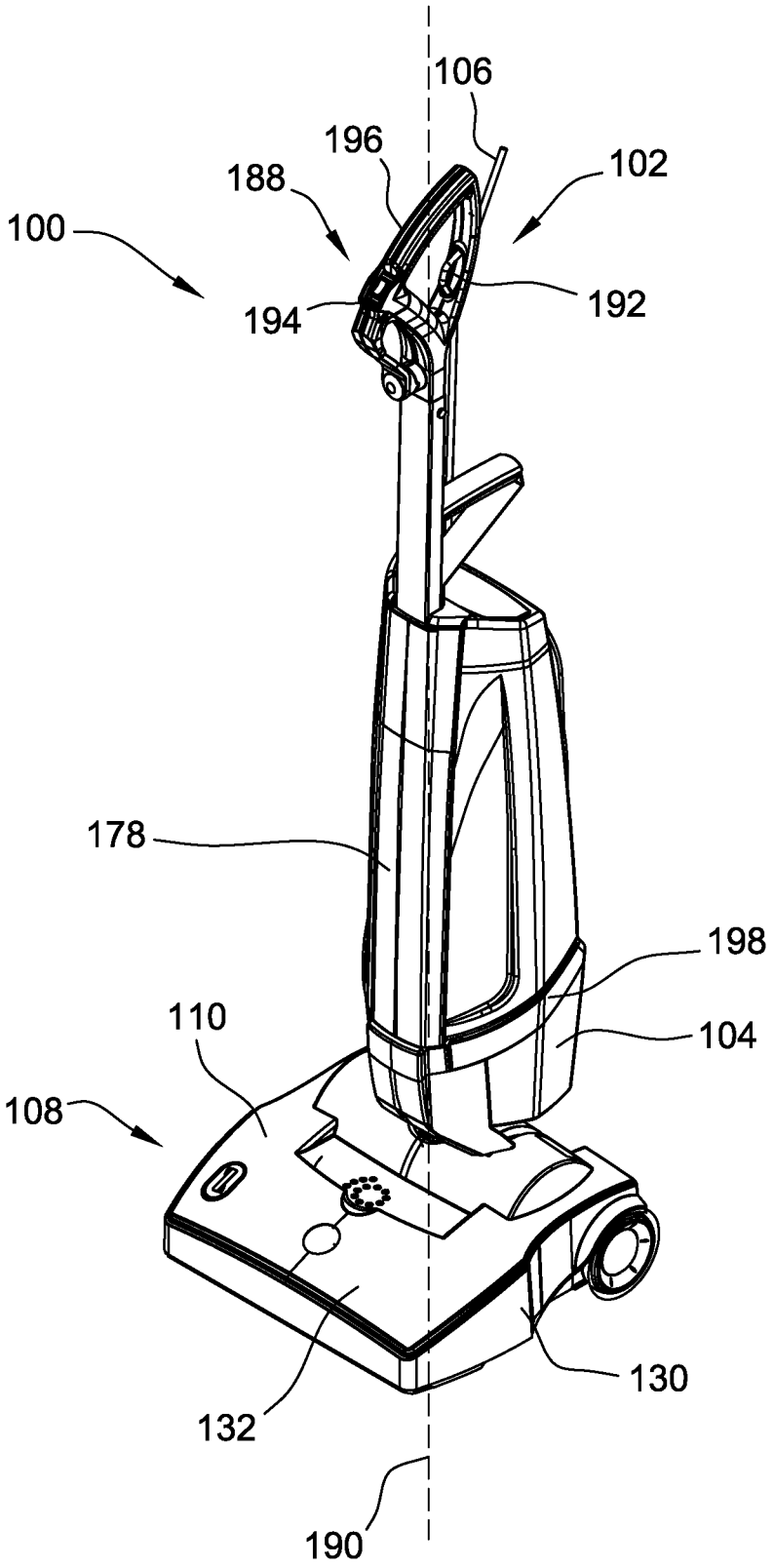
FIG. 1 is a perspective view of a vacuum cleaning system including a vacuum cleaner.

FIG. 1 is a perspective view of an example vacuum cleaning system 100. Vacuum cleaning system 100 includes a vacuum cleaner 102, a battery 104, and a power cord 106. Vacuum cleaner 102 may be connected to and receive power from battery 104 or power cord 106. Accordingly, vacuum cleaner 102 may be operated in a cordless mode and a corded mode. In other embodiments, vacuum cleaner 102 may have any configuration that enables vacuum cleaner 102 to operate as described.

Directions refer to the orientation of vacuum cleaner 102 shown in FIG. 1 unless stated otherwise. For example, the term "vertical" refers to a direction parallel to a longitudinal axis 190 of vacuum cleaner 102. The term "horizontal" refers to a direction perpendicular to longitudinal axis 190.

Figure 2:
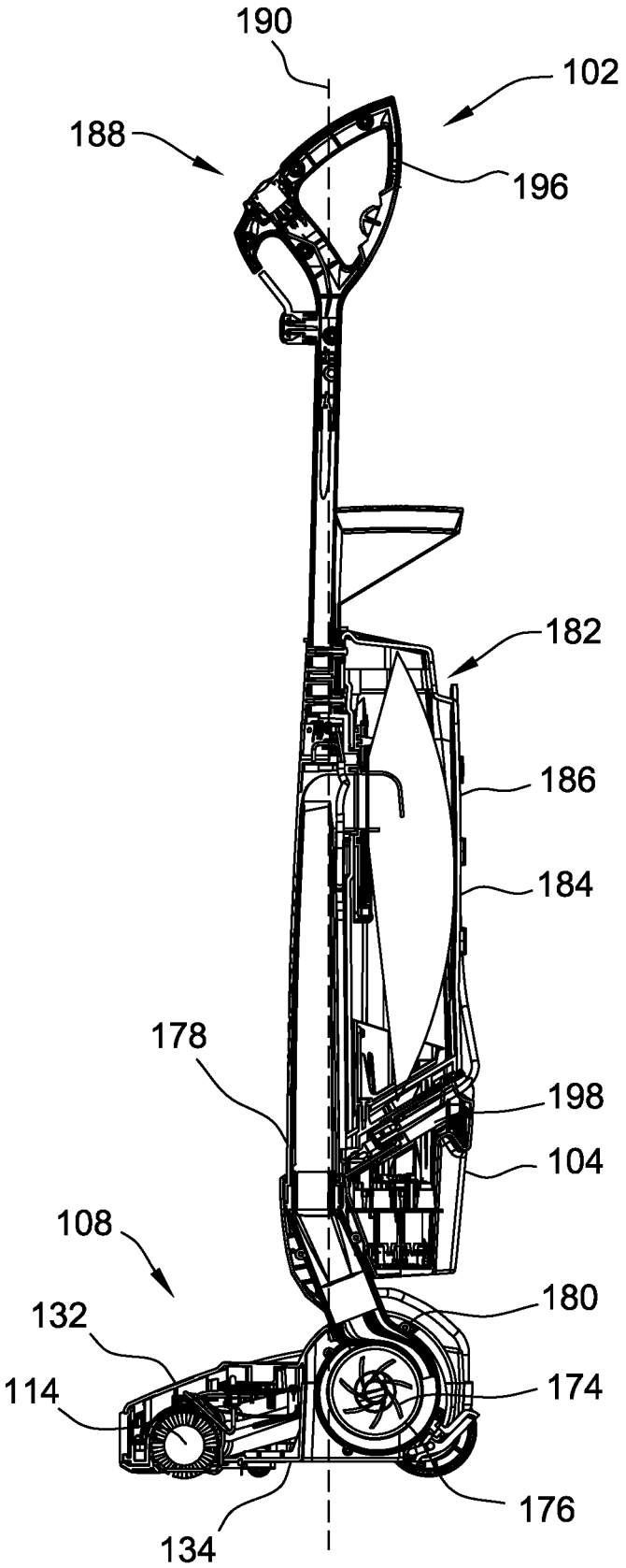
FIG. 2 is a sectional side view of the vacuum cleaner.
Figure 3:
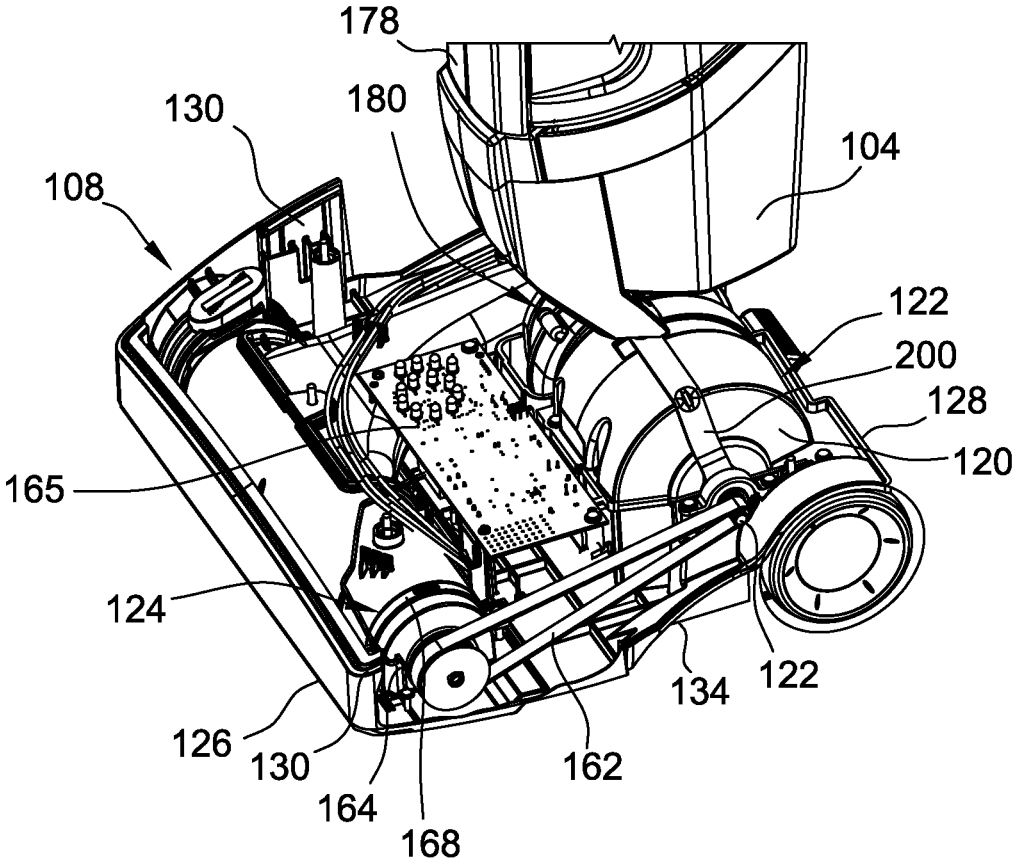
FIG. 3 is a perspective view of a cleaning head of the vacuum cleaner with a top cover removed.
Figure 4:
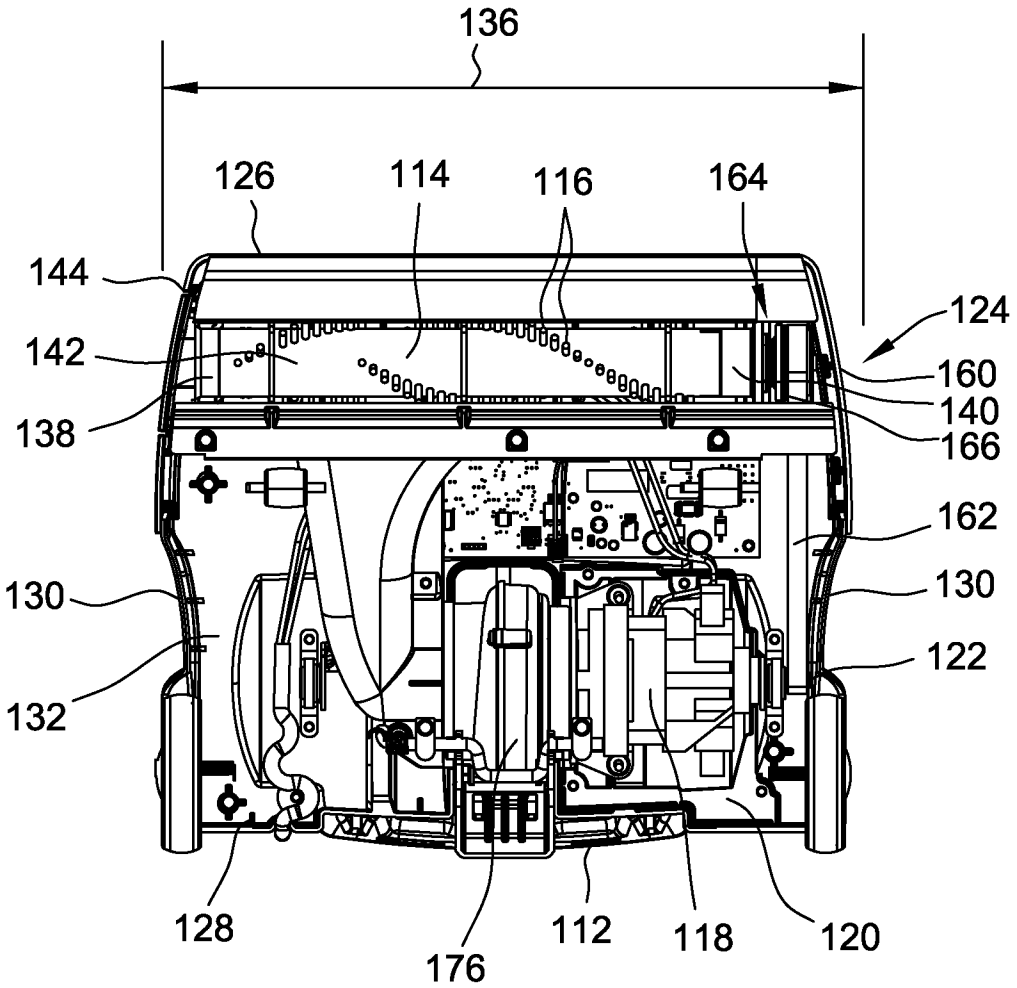
FIG. 4 is a bottom view of the cleaning head with a bottom cover removed.

In reference to FIGS. 2-4, vacuum cleaner 102 includes a cleaning head 108 for removing debris from a floor and directing the debris into vacuum cleaner 102. Cleaning head 108 includes a housing 110, a motor assembly 112, and a rotary brush 114. Housing 110 at least partially covers motor assembly 112 and rotary brush 114. Motor assembly 112 powers rotary brush 114 which includes one or more brushes 116 that rotate and contact the floor to agitate debris and promote entrainment of the debris into airflow through vacuum cleaner 102. Motor assembly 112 includes a motor 118, a motor housing 120, and a rotatable drive shaft 122. Drive shaft 122 of motor assembly 112 is operatively connected to rotary brush 114 by a pulley assembly 124. In other embodiments, cleaning head 108 may have any configuration that enables vacuum cleaner 102 to operate as described.

Housing 110 includes a front wall 126, a rear wall 128, sidewalls 130, a top cover 132, and a bottom cover 134. Sidewalls 130 extend between front wall 126 and rear wall 128. A width 136 of cleaning head 108 is defined between sidewalls 130. Top cover 132 and bottom cover 134 are attached to front wall 126, rear wall 128, and sidewalls 130 on opposite sides. In alternative embodiments, cleaning head 108 may include any housing 110 that enables vacuum cleaner 102 to operate as described herein.

As shown in FIG. 4, rotary brush 114 is positioned in cleaning head 108 between sidewalls 130. Rotary brush 114 has a first end 138, a second end 140, and a cylindrical wall 142 extending between first end 138 and second end 140. Brushes 116 extend from wall 142 and contact debris during operation of vacuum cleaner 102. In other embodiments, vacuum cleaner 102 may include any rotary brush 114 that enables vacuum cleaner 102 to operate as described.

Figure 5:
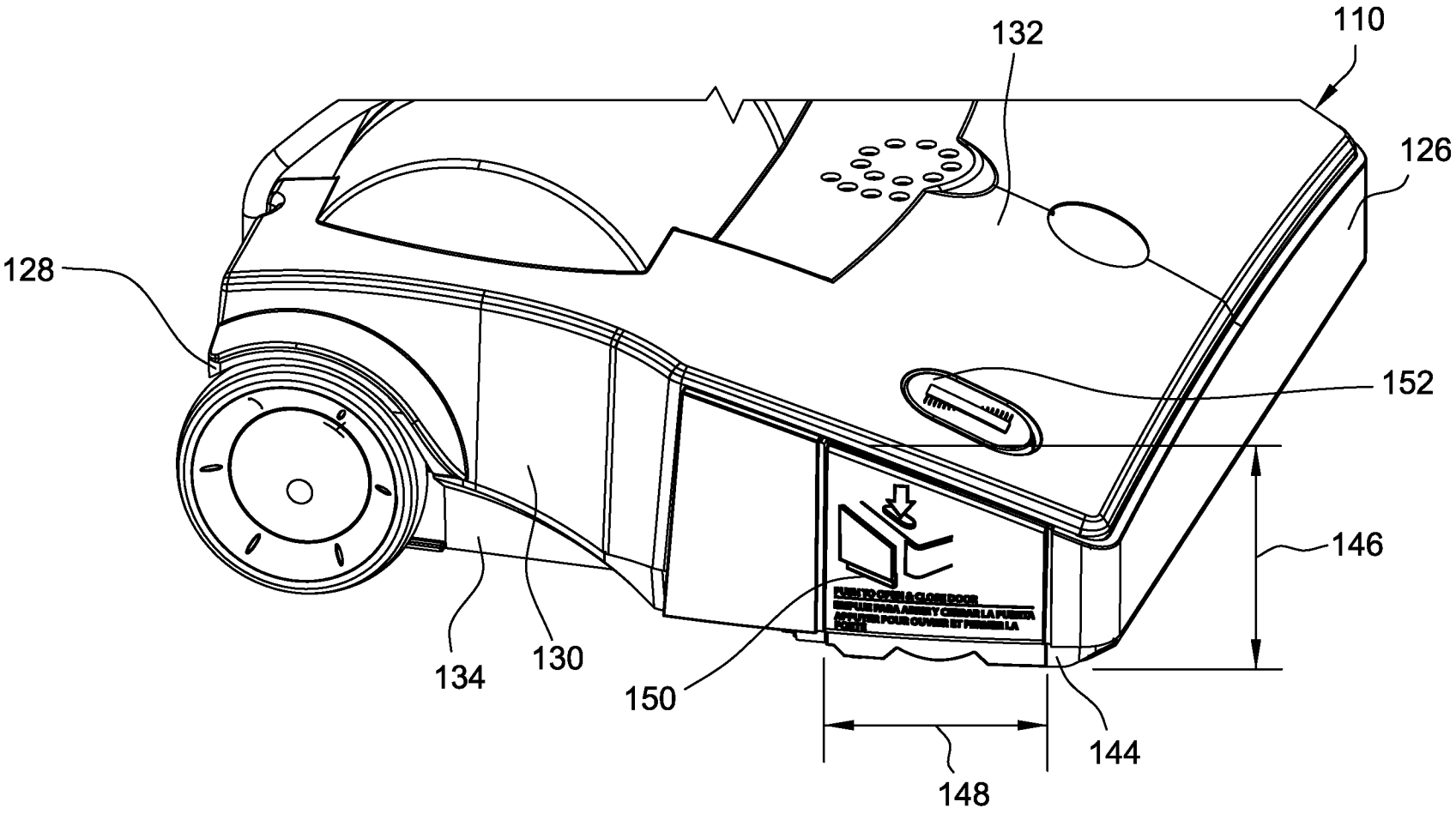
FIG. 5 is a side perspective view of a portion of the cleaning head showing a removable panel.
Figure 6:
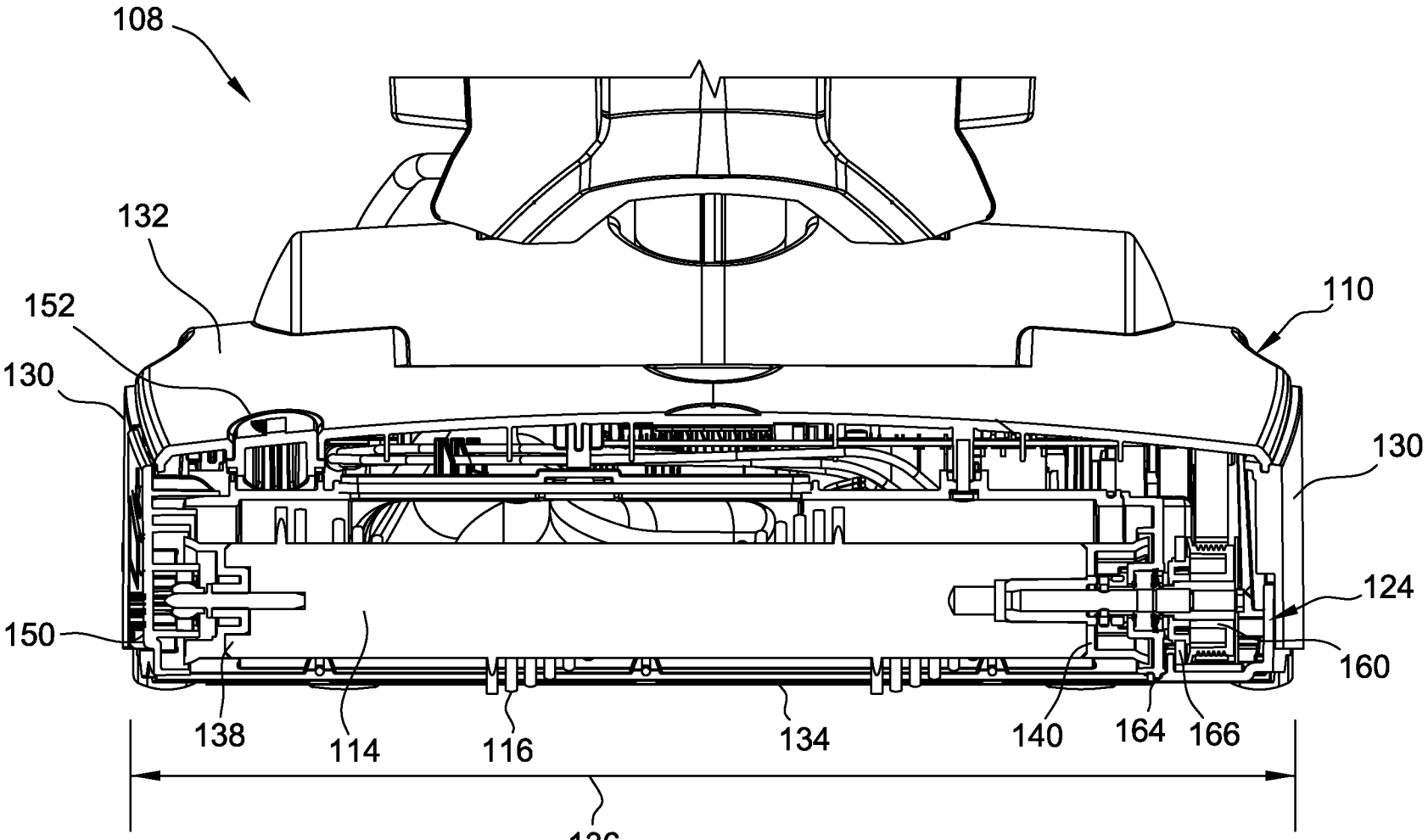
FIG. 6 is a sectional front view of the cleaning head showing a rotary brush assembly.

In reference to FIGS. 5 and 6, in this embodiment, sidewall 130 defines an opening 144. Opening 144 has a height 146 and a width 148 that are larger than a radius of rotary brush 114. For example, in some embodiments, height 146 is in a range of about 30 millimeters (mm) to about 130 mm. Width 148 is in a range of about 30 mm to about 130 mm. Accordingly, rotary brush 114 may be removed through opening 144. In addition, opening 144 allows rotary brush 114 to be removed axially because opening 144 is defined by sidewall 130. As a result, opening 144 may be smaller than conventional openings that extend longitudinally along a rotary brush.

A removable panel 150 is attached to sidewall 130 and covers opening 144. Removable panel 150 engages first end 138 of rotary brush 114. Accordingly, removable panel 150 secures rotary brush 114 in cleaning head 108. When removable panel 150 is detached from sidewall 130, rotary brush 114 may be removed from cleaning head 108 through opening 144. A button 152 on top cover 132 allows a user to release removable panel 150 from sidewall 130. Removable panel 150 and housing 110 may include indicators to instruct users on removing removable panel 150 and replacing rotary brush 114. In this embodiment, a user presses button 152 and button 152 releases a catch on removable panel 150 to allow removable panel 150 to be removed from sidewall 130. Accordingly, removable panel 150 and opening 144 allow rotary brush 114 to be removed and replaced without tools and without disassembling portions of cleaning head 108. In other embodiments, vacuum cleaner 102 may include any removable panel 150 that enables vacuum cleaner 102 to operate as described.

Figure 7:
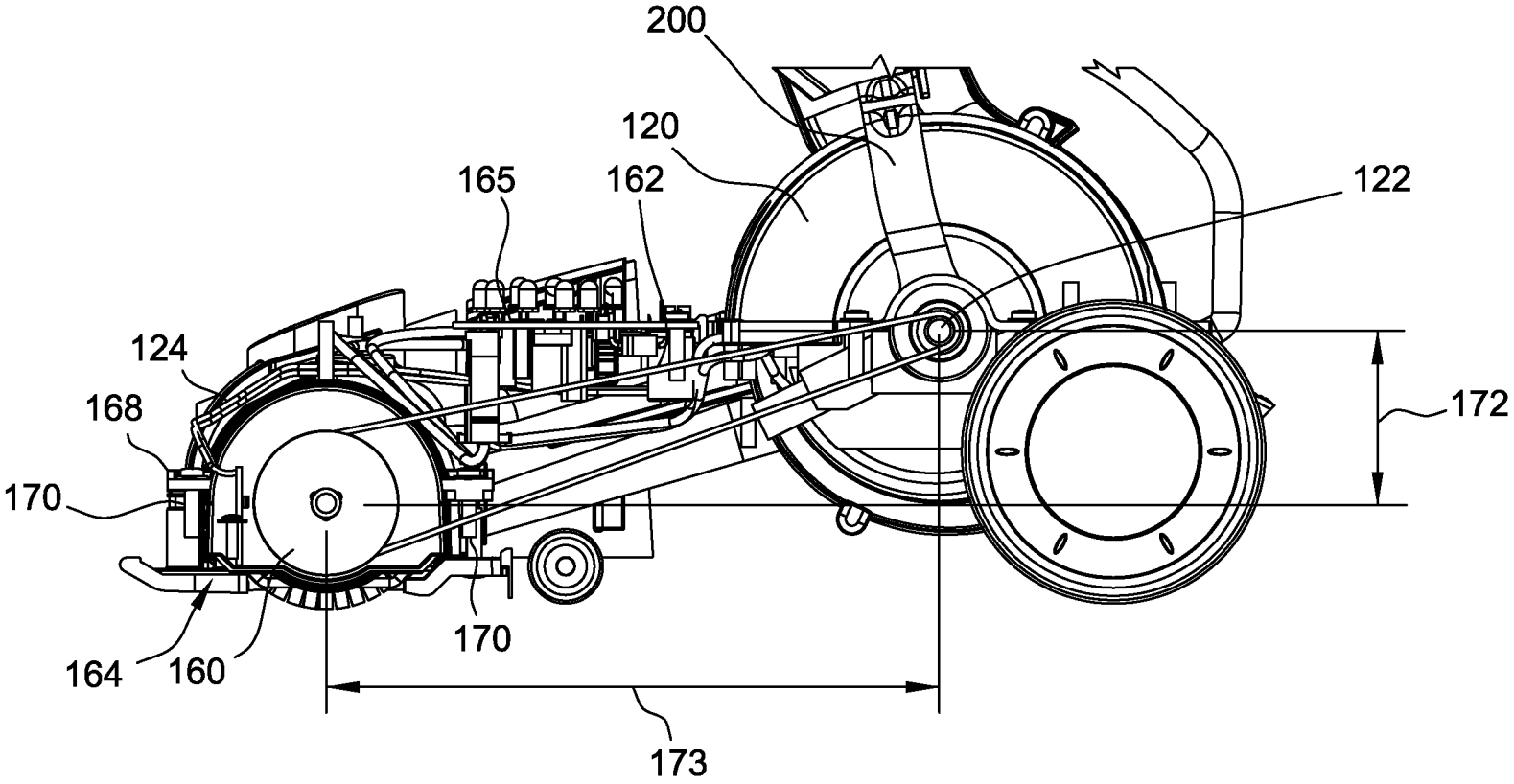
FIG. 7 is a side view of the cleaning head with a housing removed to show a pulley assembly.

In reference to FIG. 7, pulley assembly 124 includes a clutch 160, a belt 162, and a sensor 164. Clutch 160 is connected to second end 140 of rotary brush 114. Belt 162 extends between clutch 160 and drive shaft 122 to connect clutch 160 to motor 118. During operation of motor 118, clutch 160 is rotated by belt 162 at a first speed and clutch 160 rotates rotary brush 114 at a second speed such that rotary brush 114 agitates debris. In other embodiments, pulley assembly 124 may include any clutch 160 that enables pulley assembly 124 to operate as described.

Referring now to FIGS. 6 and 7, sensor 164 is connected to clutch 160 to detect a rotational speed of clutch 160 and rotary brush 114. In particular, sensor 164 includes a magnet 166 attached directly to clutch 160. In this embodiment, magnet 166 is annular and rotates with clutch 160. Sensor 164 detects the rotational speed of clutch 160 based on the magnetic field of magnet 166. For example, in some embodiments, sensor 164 includes a Hall effect sensor. In other embodiments, pulley assembly 124 may include any sensor that enables pulley assembly 124 to function as described.

Rotary brush 114 may rotate at any speed that enables rotary brush 114 to agitate debris and entrain the debris into an airflow. For example, in some embodiments, rotary brush 114 may rotate at a speed in a range of about 3,000 rotations per minute (rpm) to about 6,000 rpm or about 4,000 rpm to about 5,000 rpm. Sensor 164 may detect when rotary brush 114 is rotating at a speed outside of the desired range. For example, in some embodiments, sensor 164 may detect when rotary brush 114 is rotating at a speed less than about 3,000 rpm or less than about 2,000 rpm. Sensor 164 may send a signal relating to the rotational speed to a control board 165. Control board 165 may stop operation of motor 118 when control board 165 or sensor 164 determines rotary brush 114 is operating outside the desired range.

As a result, sensor 164 may reduce the cost to assemble and maintain vacuum cleaner 102. For example, sensor 164 more reliably and quickly detects obstructions of rotary brush 114 because sensor 164 directly detects rotation of pulley assembly 124. As a result, motor 118 may be stopped before motor 118 is damaged due to obstructions of rotary brush 114. In addition, sensor 164 may be connected to components that are relatively inexpensive to assemble and replace in comparison to components such as a magnetron.

As shown in FIG. 7, a clamp 168 extends over clutch 160 and secures clutch 160 to bottom cover 134 (shown in FIG. 6). Fasteners or screws 170 extend through openings in clamp 168 and bottom cover 134 to secure clamp 168 to bottom cover 134. Screws 170 may be rotated to adjust clamp 168 between an unfastened position and a fastened position. In particular, screws 170 are tightened to move clamp 168 from the unfastened position to the fastened position. Screws 170 may be loosened to move clamp 168 from the fastened position to the unfastened position. Accordingly, clamp 168 aligns clutch 160 relative to shaft 122 and rotary brush 114 (shown in FIG. 6). In this embodiment, screws 170 are partially secured in clamp 168 and bottom cover 134 in the unfastened position to initially position clutch 160 relative to shaft 122 and rotary brush 114. In the fastened position, clamp 168 secures clutch 160 and belt 162 in an operative position.

In this embodiment, clutch 160 and shaft 122 are aligned along width 136 (shown in FIG. 6) of cleaning head 108 when clamp 168 is in the unfastened position and the fastened position. Clutch 160 and shaft 122 are spaced apart a distance 172 in a vertical direction and a distance 173 in a horizontal direction. Distances 172, 173 may be adjusted by moving clamp 168 between the unfastened position and the fastened position. In the unfastened position, clutch 160 is closer to shaft 122. In the fastened position, clutch 160 is farther from shaft 122. In other words, distances 172, 173 increase when clamp 168 is moved from the unfastened position to the fastened position. As a result, the tension in belt 162 may be adjusted by moving clamp 168 between the unfastened position and the fastened position. In particular, belt 162 is tighter when clamp 168 is in the fastened position than when clamp 168 is in the unfastened position. In other embodiments, belt 162 may be tightened in any manner that enables pulley assembly 124 to operate as described. For example, in some embodiments, pulley assembly 124 may include a movable or hinged portion that allows belt 162 to be tightened.

Clamp 168 reduces the time and effort required to assemble pulley assembly 124. For example, a user may position belt 162 on shaft 122 and clutch 160 while clamp 168 is in the unfastened position. Accordingly, clamp 168 allows the user to position belt 162 on clutch 160 and shaft 122 without stretching belt 162. In addition, the user does not have to reposition clutch and stretch belt 162 after placing belt 162 on clutch 160 because clutch 160 is positioned by clamp 168. To move clamp 168 from the unfastened position to the fastened position, screws 170 are tightened. As a result of tightening screws 170, clutch 160 is moved farther from shaft 122 and the tension in belt 162 is increased. In other embodiments, pulley assembly 124 may be secured to cleaning head 108 in any manner that enables pulley assembly 124 to function as described.

In reference to FIGS. 2 and 4, a blower or fan 174 pulls air and debris from rotary brush 114, through a blower housing 176 and into blower 174. Blower 174 is connected to motor 118 on a side opposite pulley assembly 124. Blower 174 pushes the air and debris into a debris tube 178 that extends upward from cleaning head 108. Debris tube 178 is pivotally attached to cleaning head 108 by a hinge 180. Hinge 180 is centered between sidewalls 130 of housing 110.

Debris tube 178 is fluidly connected to blower 174 and a filter assembly 182. Air and debris travel up debris tube 178 and are discharged into filter assembly 182, where debris is filtered from the air and collected. Filter assembly 182 is disposed within a filter housing 184. Filter housing 184 may include rigid (e.g., plastic) and/or flexible (e.g., fabric) components.

In this embodiment, filter housing 184 includes an access door 186 to allow access to filter assembly 182 (e.g., to insert or remove a filter). Filter assembly 182 may include any filter that allows air to pass through and retains at least some debris within filter assembly 182. For example, in some embodiments, filter assembly 182 may include a flexible filter such as a bag filter. In other embodiments, filter assembly 182 may include a rigid filter.

In reference to FIGS. 1 and 2, a handle assembly 188 is attached to debris tube 178. Handle assembly 188 extends vertically from debris tube 178 along longitudinal axis 190 of vacuum cleaner 102. Handle assembly 188 includes a cord holder 192, a power switch 194, and a handle 196. Power switch 194 is attached to handle 196 and is positionable between an ON position and an OFF position to control power to vacuum cleaner 102. In other embodiments, vacuum cleaner 102 may include any handle assembly 188 that enables vacuum cleaner 102 to operate as described.

As shown in FIG. 2, hinge 180 pivotably attaches debris tube 178 to cleaning head 108. In particular, hinge 180 connects blower housing 176 and debris tube 178 such that air and debris may flow from blower housing 176 through hinge 180 into debris tube 178. Hinge 180 allows debris tube 178 to rotate relative to cleaning head 108. In some embodiments, debris tube 178 may be locked at certain rotation positions. For example, an operator may lock the debris tube 178 in a vertical position when vacuum cleaner 102 is stored. The operator may unlock debris tube 178 to allow debris tube 178 to freely rotate relative to cleaning head 108 during operation. In alternative embodiments, debris tube 178 may rotate in any suitable manner.

Battery 104 may be releasably attached to and supported by a battery support plate 198. Battery support plate 198 is attached to and extends from debris tube 178. Accordingly, debris tube 178 supports the weight of battery 104 during operation of vacuum cleaner 102. Braces 200 (shown in FIG. 3) provide support to debris tube 178 and may carry at least a portion of the weight of battery 104. At least one of braces 200 is positioned on drive shaft 122 next to pulley assembly 124. In other embodiments, battery 104 may be connected to vacuum cleaner 102 and supported in any manner that enables vacuum cleaner 102 to operate as described.

Compared to conventional vacuum cleaning systems, the vacuum cleaning systems of embodiments of the present disclosure have several advantages. For example, embodiments of the upright vacuum cleaner include a pulley assembly that automatically tightens a belt extending between a clutch and a drive shaft when the pulley assembly is fully secured to a housing. Accordingly, the time required to assemble and maintain the vacuum cleaner is reduced. In addition, the vacuum cleaner includes a removable panel in a side of the vacuum cleaner to allow a rotary brush to be removed without disassembling the vacuum cleaner. Moreover, the vacuum cleaner includes a sensor directly connected to the clutch to detect a rotational speed of the rotary brush. Accordingly, the sensor is more reliable and allows the vacuum cleaner to immediately shut off when the sensor detects the rotational speed of the rotary brush is outside a desired range. As a result, the service life of the belt may be increased and the risk of belt failure due to jammed brush conditions is reduced.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. An upright vacuum cleaner comprising:

a cleaning head for removing debris from a floor;

a rotary brush for agitating the debris;

a debris tube connected to the cleaning head for receiving the debris from the cleaning head;

a motor to drive the rotary brush, the motor including a rotatable drive shaft;

a pulley assembly adapted to connect the motor to the rotary brush, the pulley assembly including a clutch and a belt, the belt adapted to extend between the drive shaft and the clutch, wherein the clutch is connected to the rotary brush to rotate the rotary brush; and a clamp connecting the clutch to the cleaning head, the clamp being positionable between an unfastened position and a fastened position, wherein the tightness of the belt is adjusted when the clamp moves between the unfastened position and the fastened position.

2. The upright vacuum cleaner of claim 1, wherein the clamp extends across the clutch and is connected to the cleaning head by screws, the clamp being moved between the unfastened position and the fastened position by rotating the screws.

3. The upright vacuum cleaner of claim 1, wherein the clutch and the drive shaft are separated by a first distance when the clamp is in the unfastened position, the clutch and the drive shaft being separated by a second distance greater than the first distance when the clamp is in the fastened position.

4. The upright vacuum cleaner of claim 1, wherein the cleaning head includes a housing, the housing including a removable panel on an end of the rotary brush, the rotary brush extending between the removable panel and the clutch such that the removable panel and clutch are on opposite ends of the rotary brush.

5. The upright vacuum cleaner of claim 4, wherein the housing includes a front wall, a rear wall, a first sidewall, and a second sidewall, the first sidewall and the second sidewall extending between the front wall and rear wall, the rotary brush being positioned between the first sidewall and the second sidewall, wherein the first sidewall defines an opening for removal of the rotary brush, the removable panel covering the opening.

6. The upright vacuum cleaner of claim 5, wherein the cleaning head includes a button to release the removable panel from the housing.

7. The upright vacuum cleaner of claim 6, wherein the housing includes a cover connected to the front wall, the rear wall, the first sidewall, and the second sidewall, the button being on the cover.

8. The upright vacuum cleaner of claim 1 further comprising a sensor connected to the clutch, wherein the sensor detects a rotational speed of the clutch.

9. The upright vacuum cleaner of claim 8, wherein the sensor includes a magnet attached to the clutch.

10. The upright vacuum cleaner of claim 1 further including a fan to direct an airflow through the cleaning head, the rotary brush entraining the debris into the airflow, wherein the fan is connected to an end of the motor opposite the belt.

* * * * *